US006564857B1

(12) United States Patent
Zobel et al.

(10) Patent No.: US 6,564,857 B1
(45) Date of Patent: May 20, 2003

(54) COMPACT COOLING SYSTEM

(75) Inventors: Werner Zobel, Böblingen (DE); Michael Ehlers, Nagold (DE); Frank Vetter, Filderstadt (DE); Jörg Soldner, Ehningen (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/672,428

(22) Filed: Sep. 28, 2000

(30) Foreign Application Priority Data

Oct. 21, 1999 (DE) ..... 199 50 753

(51) Int. Cl.[7] ..... B60H 3/04; B60K 11/06; B60K 11/08; F28D 1/00; F01P 1/06

(52) U.S. Cl. ..... 165/41; 165/51; 165/125; 165/140; 165/149; 165/82; 165/916; 123/41.49

(58) Field of Search ..... 165/41, 51, 125, 165/82, 149, 140, 99, 175, 916; 123/41.49

(56) References Cited

U.S. PATENT DOCUMENTS

| | | | | | |
|---|---|---|---|---|---|
| 1,872,785 | A | * | 8/1932 | Modine | 165/125 |
| 2,368,732 | A | * | 2/1945 | Wallgren | |
| 2,662,748 | A | * | 12/1953 | Huber | 165/91 |
| 3,800,866 | A | * | 4/1974 | Ireland et al. | 165/125 |
| 3,921,603 | A | * | 11/1975 | Bentz et al. | 165/51 |
| 3,978,919 | A | * | 9/1976 | Fachbach et al. | 165/125 |
| 4,062,401 | A | * | 12/1977 | Fudny et al. | 165/125 |
| 4,066,047 | A | * | 1/1978 | Vidakovic et al. | 165/125 |
| 4,116,171 | A | * | 9/1978 | Schulmeister et al. | 165/125 |
| 4,202,296 | A | | 5/1980 | Nonnenmann et al. | 123/41.49 |
| 4,540,044 | A | * | 9/1985 | Lenz | 165/51 |
| 5,172,752 | A | * | 12/1992 | Goetz, Jr. | 123/41.49 |
| 5,522,457 | A | | 6/1996 | Lenz | 123/41.49 |
| 6,129,056 | A | * | 10/2000 | Skeel et al. | 123/41.49 |
| 6,321,830 | B1 | * | 11/2001 | Steinmann | 165/51 |

FOREIGN PATENT DOCUMENTS

| | | | | |
|---|---|---|---|---|
| AT | 130338 | * | 5/1932 | 165/125 |
| CH | 530607 | * | 12/1972 | |
| DE | 2716997 B2 | | 3/1979 | |
| DE | 3148942 C2 | | 12/1983 | |
| DE | 19724728 A1 | | 2/1999 | |
| EP | 0323356 | * | 7/1989 | 165/125 |
| EP | 0597767 | * | 5/1994 | 165/149 |
| GB | 520651 | * | 4/1940 | 165/125 |
| GB | 2065860 | * | 7/1981 | 165/125 |
| JP | 4-369388 | * | 12/1992 | 165/175 |

* cited by examiner

*Primary Examiner*—John K. Ford
(74) *Attorney, Agent, or Firm*—Wood, Phillips, Katz, Clark & Mortimer

(57) ABSTRACT

A compact cooling system includes a mounting panel adapted to receive a plurality of at least three cooling units, a cooling fan, and a fan drive mechanism. The mounting panel supports the fan and drive mechanism in a manner allowing rotation of the fan about the axis of rotation. A front side of the mounting panel is adapted for receiving and supporting the cooling units in a pattern defining a cantilevered, tubular polygonal solid disposed about the fan. The mounting panel includes a convex central region extending into the tubular polygonal solid and receiving the drive mechanism in operative connection to the fan. By virtue of this arrangement, a very compact cooling system is provided. The tubular polygonal shape of the cooling units, when mounted on the mounting panel, forms an air duct for directing a flow of cooling air induced by the fan through the cooling units. Positioning the drive mechanism inside the convex central region of the mounting panel significantly reduces the length of the cooling system along the axis of rotation.

8 Claims, 4 Drawing Sheets

COMPACT COOLING SYSTEM

RELATED APPLICATIONS

This application claims priority to German Patent Application No. 199 50 7538 filed Oct. 21, 1999.

FIELD OF THE INVENTION

This invention is directed to systems for cooling one or more streams of fluid with air, and more particularly to such systems for use in vehicles.

BACKGROUND OF THE INVENTION

Modern vehicles such as large trucks, include many fluid circuits that require removal of large amounts of heat during operation of the vehicle to achieve peak performance, long life and prevent breakdown of the vehicle. It is not uncommon in such vehicles to have a water-based cooling unit for cooling of the vehicle engine, one or more oil coolers for hydraulic circuits of the vehicle, an engine charge air cooling circuit, and one or more refrigeration units for providing air conditioning of the driver compartment and perhaps refrigeration of a cargo compartment of the vehicle.

As vehicles have become more powerful, and equipped with more systems requiring cooling, the volume of air flow necessary to provide cooling for these fluids has increased dramatically. Large fans are required to provide the necessary volume of air. As the size of the fans has grown, the demands on the structure of the cooling system for supporting the fan have grown as well.

At the same time as the size of the cooling loads and fans have been increasing dramatically, customers and government regulators are demanding improved efficiency and fuel utilization in vehicles. In order to meet these demands, it is highly desirable to make a cooling system as compact as possible, while maintaining overall ruggedness for environmental and servicing cost reasons, and to minimize both the original and life cycle cost of ownership.

It is an object of the invention to provide an improved cooling system. Other objects of the invention include:

(1) providing an improved cooling system for use in vehicles;

(2) to provide a system which is compact in size, and of minimal weight;

(3) to provide a system having great flexibility to be tailored to the needs of a particular application; and (4) a system of rugged straightforward construction.

SUMMARY OF THE INVENTION

Our invention provides such an improved cooling system through the use of a panel for mounting a plurality of at least three cooling units, a cooling fan, and a fan drive mechanism. The mounting panel supports the fan and drive mechanism in a manner allowing rotation of the fan about an axis of rotation. A front side of the mounting panel is adapted for receiving and supporting the cooling units in a pattern defining a housing in the form of a polygonal solid disposed about the fan. The mounting panel includes a convex central region extending into the polygonal solid housing mounting the drive mechanism and the fan.

By virtue of this arrangement, a very compact cooling system is provided. The polygonal shape of the cooling units defines an air duct for directing a flow of cooling air induced by the fan through the cooling units. Positioning the drive mechanism inside the convex central region of the mounting panel significantly reduces the length of the cooling system along the axis of rotation. All of the parts of the cooling system perform multiple functions, thereby contributing to simplicity of design, ruggedness of construction and operation, and minimal size and weight of the cooling system.

In one embodiment of our invention, the cooling assembly includes a front panel joined to the sides of the cooling units remote from the mounting panel. In a preferred embodiment, the front panel includes an inlet nozzle for directing air to the fan, and the air flow induced by the fan is directed radially outwardly through heat exchangers in the cooling units.

According to another aspect of our invention, the cooling system includes flow channels for connecting the cooling units, with the flow channels being mounted on a backside of the mounting panel. In some embodiments incorporating this aspect of our invention, the cooling channels are utilized to link together two or more cooling units which are part of the same fluid circuit. In preferred embodiments, the cooling channels are integrally formed in the mounting panel, to thereby add structural integrity to the mounting panel.

According to another aspect of our invention, the convex central region of the mounting panel terminates in an adapter plate for receiving the fan drive mechanism, and the mounting panel includes a number of corner connector regions equal to the number of cooling units. The mounting panel also includes a plurality of support struts extending between and integrally joining the corner connector regions to the adapter plate. In preferred embodiments according to this aspect of our invention, at least one of the corner connector regions of the mounting panel includes an aperture for passage of fluid between the cooling units and the flow channels. In some embodiments according to this aspect of our invention, the mounting panel includes cover segments between the struts which are removable from the remainder of the mounting panel to provide access to the interior of the cooling system.

In preferred embodiments of our invention, the mounting panel includes a round and a slotted mounting hole for fasteners joining each cooling unit to the mounting panel. The slotted mounting hole allows for thermal expansion and contraction of the cooling unit during operation. Other features, aspects and advantages of our invention will be apparent to those having skill in the art upon review of the attached drawings and the following detailed description.

DETAILED DESCRIPTION OF THE PREFERRED EMBODIMENT

Figure 1:
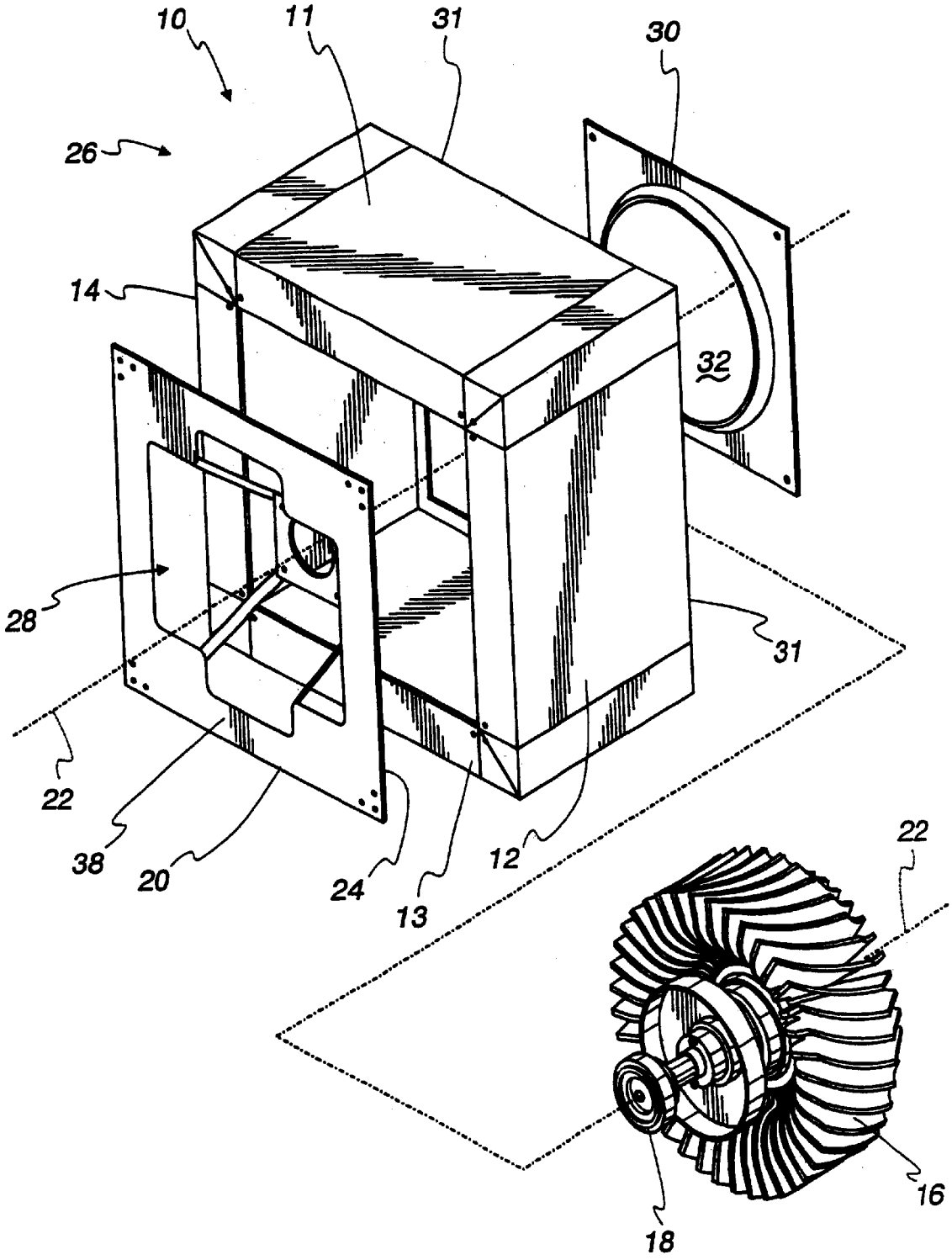
FIG. 1 is an isometric view of a cooling system according to our invention.
Figure 2:
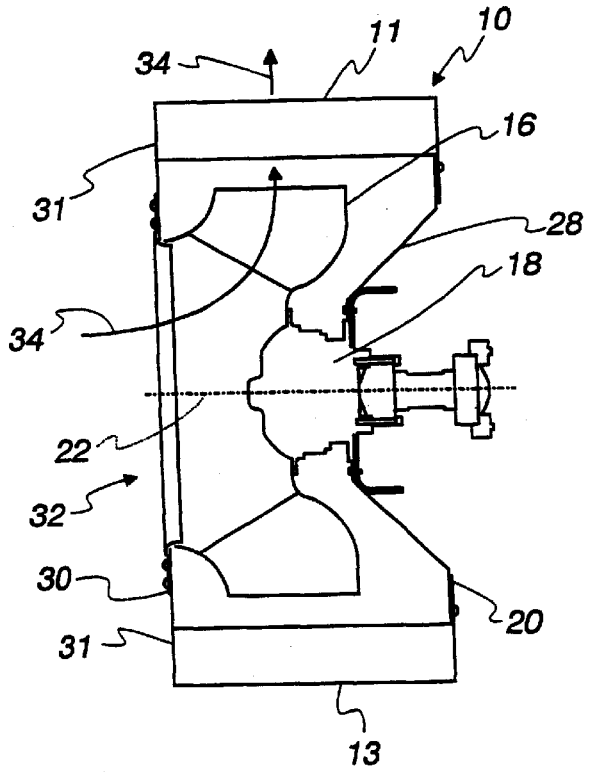
FIG. 2 is a cross-sectional view of the cooling system of FIG. 1.

FIG. 1 depicts an exemplary embodiment of a cooling system 10 according to our invention including four cooling units 11,12,13,14, a radial discharge cooling fan 16, a fan drive mechanism 18 and a mounting panel 20. As shown in FIGS. 1 and 2, the mounting panel 20 supports the fan 16 and drive mechanism 18 for rotation about an axis of rotation 22. The front side 24 of the mounting panel 20 is adapted for receiving and supporting the cooling units 11–14 in a pattern defining an open centered housing 26 in the form of a rectangular-shaped polygonal solid extending D from the front side 24 of the mounting panel 20 and disposed about the fan 16. The mounting panel 20 includes a convex central region 28 extending into the housing 26 and mounts the drive mechanism 18 and fan 16 which is driven thereby.

The cooling system 10 includes a front panel 30 joined to the sides 31 of the cooling units 11–14 remote from the mounting panel 20 and includes an inlet 32 for directing air to the fan 16. In the embodiment depicted in FIGS. 1 and 2, the fan 16 is an axial intake, radial discharge fan, which induces a flow of air, as indicated by arrows 34, at desired pressure and with good stability through passages in heat exchangers of the cooling units 11–14. Those skilled in the art will recognize, however, that where the cooling system is used in a stationary application or where ram air is not an appreciable factor, the direction of air flow could be reversed. The inlet 32 in the front panel 30 depicted in FIGS. 1 and 2 is configured as an inlet nozzle to improve efficiency and performance of the fan 16.

Figure 3:
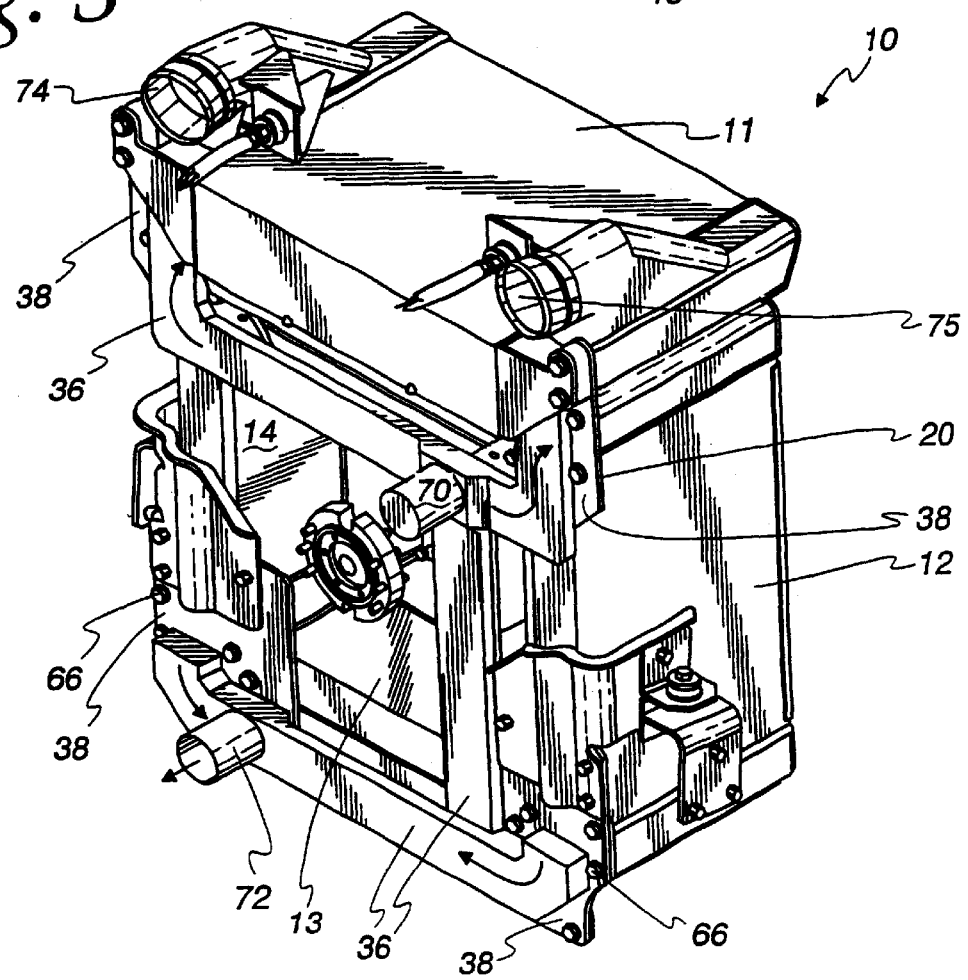
FIG. 3 is a detailed isometric view of a cooling system as depicted in FIGS. 1 and 2.

As shown in FIG. 3, the cooling system 10 includes a plurality of flow channels 36 for connecting the cooling units 12–14, with the flow channels 36 being located on a back side 38 of the mounting panel 20. The particular fluid circuit depicted will be described in greater detail below.

In the embodiment depicted, the flow channels 36 are formed as an integral part of the mounting panel 20 to provide additional structural support and stiffness to the mounting panel 20, and the cooling system 10 as a whole. Those skilled in the art will recognize that in other embodiments of our invention, it may be advantageous to have the flow channels be removable from the mounting panel 20.

Figure 4:
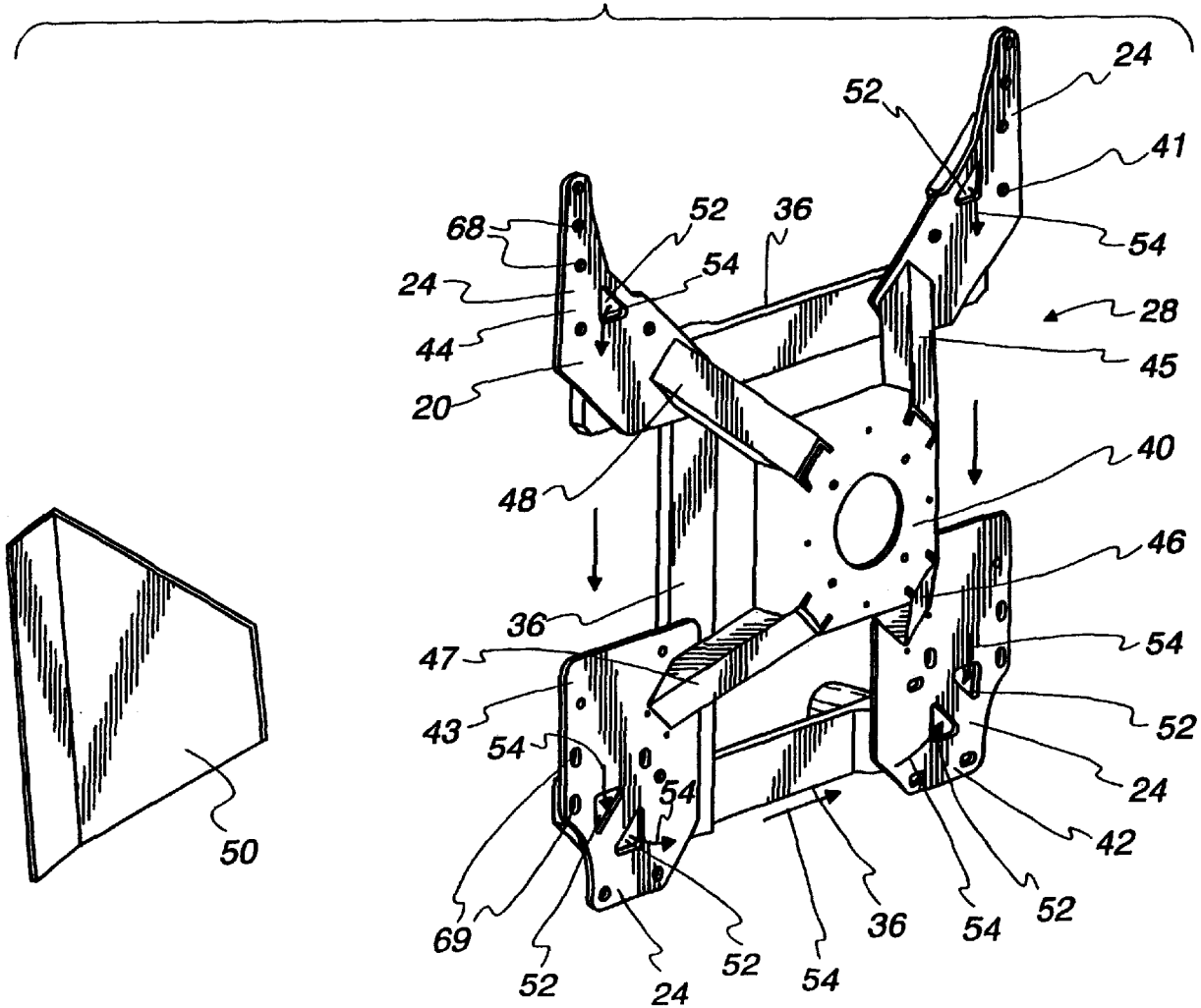
FIG. 4 is an isometric view of the mounting panel of the embodiment depicted in FIG. 3.

As shown in FIG. 4, the mounting panel 20 of the cooling system 10 depicted in FIG. 3 includes a central convex region 28 terminating in an adapter plate 40 having a pattern of mounting holes for receiving and joining the fan drive mechanism 18 to the adapter plate 40. The mounting panel 20 includes four corner connector regions 41–44, such that the number of corner connector regions 41–44 is equal to the number of cooling units 11–14. The mounting panel 20 also includes four support struts 45–48 extending between and integrally joining the corner connector regions 41–44 to the adapter plate 40.

The mounting panel 20 includes cover segments 50 to close the spaces between the support struts 45–48 and the adapter plate 40. Only one such cover segment 50 is depicted in FIG. 4, for clarity of explanation and is shown detached from the panel 20. The cover segments 50 could be removable in some embodiments of our invention to allow access to the interior of the cooling system. In other embodiments, the cover segments 50 can be formed integrally with the corner connectors 41–44, adapter plate 40 and support struts 45–48, as illustrated in the embodiment of FIG. 1, so that the cover segments 50 can contribute to the structural strength of the mounting panel 20.

As shown in FIG. 4, the corner connector regions 41–44 of the mounting plate 20 include apertures 52 for the passage of fluid, as indicated by arrows 54 between the cooling units 11–14 mounted on the front face 24 of the corner connectors 41–44, and the flow channels 36, attached to back side 38 of the mounting plate 20 and surrounding the apertures 52.

Figure 5:
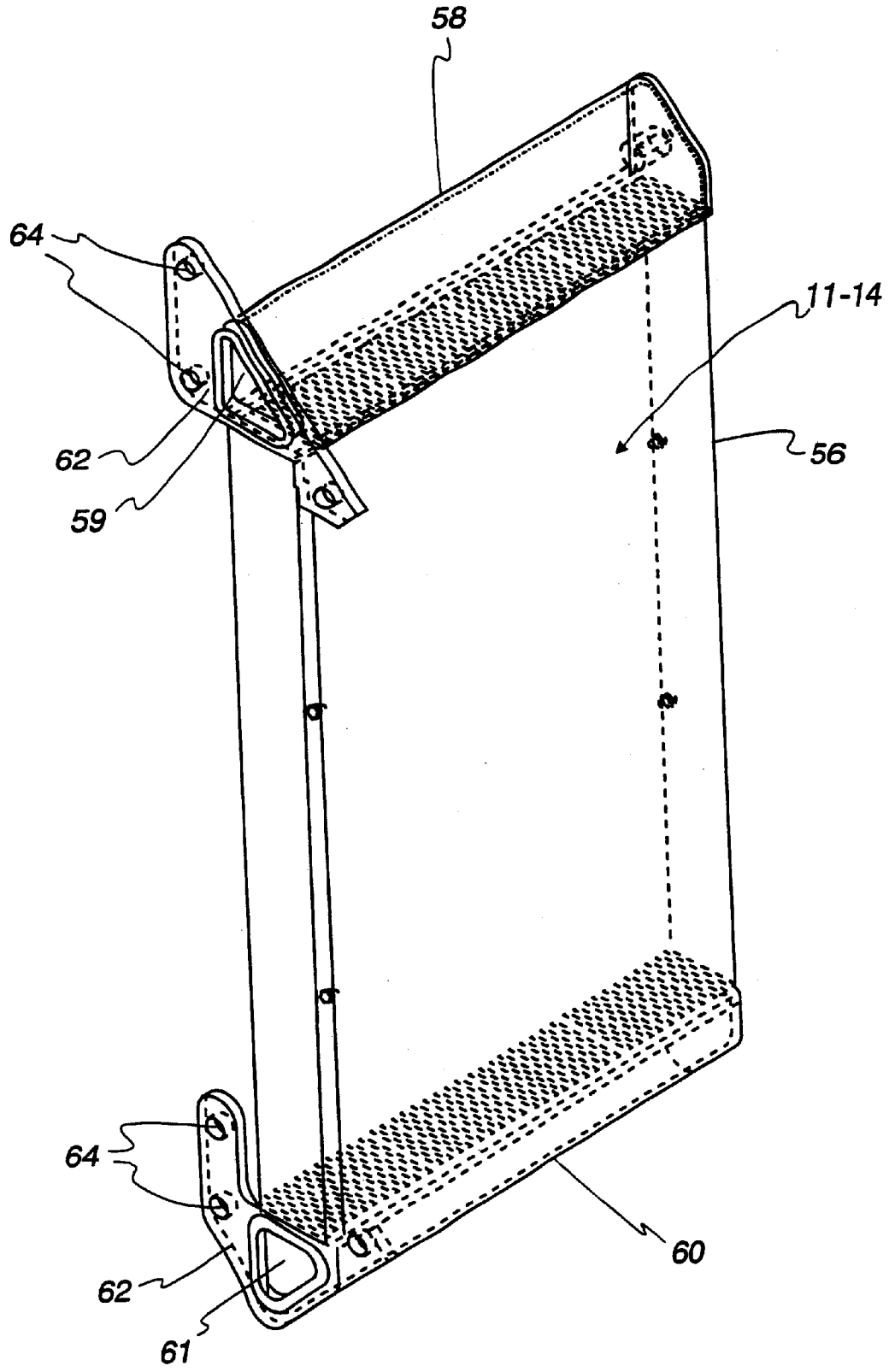
FIG. 5 is an isometric view of a heat exchanger portion of a cooling unit of the embodiment of FIG. 3.

As shown in FIG. 5, the cooling units 11–14 generally include a heat exchanger 56 having headers 58,60 at opposite ends thereof. Triangular openings 59,61 in the header and tank construction (hereinafter headers) 58,60 provide inlet and outlet passages for the fluid 54, when the heat exchanger 56 is bolted to the front face 24 of the mounting panel 20. As shown in FIGS. 3–5, the heat exchangers 56 include mounting flanges 62 with threaded holes 64 for receiving bolts 66 extending through round holes 68 and elongated slots 69 in the corner connector regions of the mounting plate 20. Those skilled in the art will recognize that the use of elongated slots 69 in conjunction with round holes 68 allows the cooling units 11–14 to expand and contract during operation.

In the embodiment of our invention depicted in FIGS. 3 and 4, the cooling unit 11 is a charge air cooler for engine combustion air and has an inlet 74 and an outlet 75 for a flow of air to be cooled by the fan 16. The other three cooling units 12–14 are all interconnected via the apertures 52 and fluid channels 36 with an inlet 70 and an outlet 72 adapted for connection to an engine coolant circuit external to the cooling system 10. Fluid entering the inlet 70 flows through the upper and vertical flow channels 36 to enter the top end of cooling units 12 and 14, and the right end of cooling unit 13, as depicted in FIG. 3. After flowing through cooling units 12, 13 and 14, in a generally parallel fashion, the fluid is collected by the lower horizontal fluid channel 36 and delivered to the outlet 72.

In some instances the cooling units 12–14 will not all be ganged as described, depending on engine cooling requirements. In such a case one or more of the units 12–14 may be employed for other purposes. As alluded to previously, one of the units 12–14 could be used as a condenser or gas cooler for an air conditioning system or as an oil cooler.

Although we have described our invention in terms of certain specific embodiments depicted in the drawings and described in the specification, those skilled in the art will readily recognize that we contemplate many other embodiments of our invention within the scope of the appended claims.

We claim:

1. A cooling system comprising:

a plurality of at least three heat exchangers, a cooling fan, a fan drive mechanism, and a mounting panel, at least one of said heat exchangers adapted to receive a flow of fluid separate from fluid flowing through the other heat exchanges in said plurality of heat exchangers;

said mounting panel supporting said fan and drive mechanism for rotation about an axis of rotation, said mounting panel having a front side adapted for receiving and supporting said heat exchangers in a pattern defining a tubular polygonal solid disposed about said fan, said mounting panel including a convex central region extending into said tubular polygonal solid and receiving said drive mechanism in operative connection to said fan, wherein said convex central region of said mounting panel terminates in an adapter plate for receiving said fan drive mechanism and said mounting panel includes a number of corner connector regions equal to the number of heat exchangers, said mounting panel also including a plurality of support struts extending between and integrally joining said corner connector regions to said adapter plate.

2. The cooling system of claim 1 including flow channels for connecting said heat exchangers, said flow channels being mounted on a backside of said mounting panel opposite said front side.

3. The cooling system of claim 2 wherein said mounting panel includes said flow channels.

4. The cooling system of claim 2 wherein at least one of said corner connector regions of said mounting panel includes an aperture for the passage of fluid between said heat exchangers and said flow channels.

5. The cooling system of claim 2 wherein said mounting panel includes cover segments between said struts.

6. The cooling system of claim 5 wherein said cover segments are removable from the remainder of said mounting panel.

7. The cooling system of claim 1 wherein one of said heat exchangers is adapted for attachment by means of a first and a second fastener to a first and a second of said corner connectors, the first corner connector having a round hole for receipt of said first fastener and said second corner connector having an elongated slot for receipt of said second fastener, said elongated slot thereby allowing for thermal expansion and contraction of said one heat exchanger.

8. The cooling system of claim 2 wherein said at least two of said heat exchangers are adapted to the part of a single fluid flow circuit and are connected in fluid communication by a common flow channel.

* * * * *